US009720379B2

(12) United States Patent
Bravo

(10) Patent No.: US 9,720,379 B2
(45) Date of Patent: Aug. 1, 2017

(54) CHRONOMETER WITH SPEED SELECTOR

(71) Applicant: The Swatch Group Management Services AG, Biel/Bienne (CH)

(72) Inventor: Paulo Bravo, Marin-Epagnier (CH)

(73) Assignee: The Swatch Group Management Services AG, Biel/Bienne (CH)

( * ) Notice: Subject to any disclaimer, the term of this patent is extended or adjusted under 35 U.S.C. 154(b) by 0 days.

(21) Appl. No.: 14/946,019

(22) Filed: Nov. 19, 2015

(65) Prior Publication Data

US 2016/0147198 A1 May 26, 2016

(30) Foreign Application Priority Data

Nov. 26, 2014 (EP) ..... 14194957

(51) Int. Cl.

| | |
|---|---|
| ***G04B 19/02*** | (2006.01) |
| ***G04F 3/02*** | (2006.01) |
| ***G04B 19/04*** | (2006.01) |
| ***G04F 7/08*** | (2006.01) |

(52) U.S. Cl.

CPC ..... *G04F 3/022* (2013.01); *G04B 19/02* (2013.01); *G04B 19/04* (2013.01); *G04F 3/02* (2013.01); *G04F 7/0852* (2013.01); *G04F 7/0871* (2013.01)

(58) Field of Classification Search

CPC ..... G04F 3/022; G04F 3/02; G04F 7/0871; G04B 27/065; G04B 27/02; G04B 19/04; G04B 19/02

See application file for complete search history.

(56) References Cited

U.S. PATENT DOCUMENTS 3,775,966 A * 12/1973 Matsuura ..... G04B 19/25 368/32
6,918,694 B2 * 7/2005 Speichinger ..... G04B 27/001 368/184
7,293,911 B2 * 11/2007 Bonvin ..... G04F 3/022 368/106

(Continued)

FOREIGN PATENT DOCUMENTS

CH 74 144 1/1917
CH 707 870 A1 10/2014

(Continued)

OTHER PUBLICATIONS

WO 2011/160970a1—Dec. 29, 2011—translated abstract.*

(Continued)

*Primary Examiner* — Sean Kayes
(74) *Attorney, Agent, or Firm* — Oblon, McClelland, Maier & Neustadt, L.L.P.

(57) ABSTRACT

The invention relates to a timepiece movement comprising at least first and second functions implementing the display of at least first and second pieces of information. According to the invention, the movement has a selection member comprising an actuator, at least one lever configured to take at least first and second positions, respectively corresponding to the first and second functions, and respectively corresponding to the creation of first and second kinematic connections, and a cam cooperating with the actuator and the at least one lever so as to create the first and second kinematic connections.

18 Claims, 8 Drawing Sheets

(56) References Cited

U.S. PATENT DOCUMENTS

| | | | | |
|---|---|---|---|---|
| 7,441,945 | B2 * | 10/2008 | Laucella | G04B 3/048 368/190 |
| 7,959,350 | B2 * | 6/2011 | Oppliger | G04F 7/08 368/101 |
| 7,980,756 | B2 * | 7/2011 | Graemiger | G04B 27/065 368/184 |
| 8,328,414 | B2 * | 12/2012 | Graemiger | G04B 27/065 368/184 |
| 9,164,482 | B2 * | 10/2015 | Villaret | F16H 57/021 |
| 9,176,476 | B2 * | 11/2015 | Loeffel | G04B 27/04 |
| 9,411,316 | B2 * | 8/2016 | Pages | G04B 27/02 |
| 2009/0010109 | A1 | 1/2009 | Graemiger et al. | |
| 2010/0097898 | A1 * | 4/2010 | Oppliger | G04F 7/0852 368/106 |
| 2011/0242947 | A1 | 10/2011 | Graemiger et al. | |
| 2012/0020192 | A1 * | 1/2012 | Calabrese | G04B 19/235 368/106 |
| 2014/0056112 | A1 * | 2/2014 | Villaret | F16H 57/021 368/33 |

FOREIGN PATENT DOCUMENTS

| | | |
|---|---|---|
| EP | 2 012 199 A2 | 1/2009 |
| FR | 701 884 | 3/1931 |
| FR | 857 402 | 9/1940 |
| WO | WO 2011/160970 A1 | 12/2011 |

OTHER PUBLICATIONS

Translated WO2011160970—Jul. 21, 2016 espacenet.com.*
Translated FR857402—Jul. 21, 2016 espacenet.com.*
Translated CH74144—Jul. 21, 2016 espacenet.com.*
European Search Report issued Aug. 27, 2015 in European Application 14194957, filed on Nov. 26, 2014 ( with English Translation).

* cited by examiner

CHRONOMETER WITH SPEED SELECTOR

This application claims priority from European Patent Application No. 14194957.8 filed on Nov. 26, 2014, the entire disclosure of which is hereby incorporated herein by reference.

FIELD OF THE INVENTION

The invention relates to a timepiece movement comprising at least a first and a second function implementing the display of at least first and second pieces of information, and notably tachymetric information.

BACKGROUND OF THE INVENTION

There is known from WO Patent No 2011/160970 a timepiece movement comprising a mechanism associated with one of the first and second functions, and a selection member movable between first and second positions, respectively associated with the first and second functions and respectively corresponding to the creation of first and second kinematic connections between the going train and the display wheel set, resulting in opposite directions of rotation and/or different rotational speeds of the display wheel set.

The first and second functions are chronograph and countdown functions, the display wheel set being intended to move the display member in a first direction when the chronograph function is actuated and in a second direction when the countdown function is actuated.

The timepiece movement described above has several drawbacks. Firstly, it will be mentioned that the countdown requires pre-setting of the countdown value, which is taken into account by the movement in order to determine the function to be actuated, which entails a complication in use. It will also be mentioned that such a mechanism has a relative large number of parts which entails a relatively complex mechanism that is difficult to implement.

SUMMARY OF THE INVENTION

It is an object of the invention to overcome the various drawbacks of these known techniques.

More specifically, it is an object of the invention to provide a tachymeter and/or chronograph that can provide a more accurate mean speed reading according to the situated encountered, such as for example a regatta or car race.

It is also an object of the invention, at least in a particular embodiment, to provide a device that is simple to implement and inexpensive.

These objects, in addition to others, which will appear more clearly hereinafter, are accomplished by the invention with the aid of a timepiece movement having at least first and second functions implementing the display of at least first and second pieces of information, the timepiece movement notably including:

- a chronograph drive wheel,
- a chronograph wheel set,
- a selection member capable of being moved between at least first and second positions, respectively associated with the first and second functions, and respectively corresponding to the creation of first and second respective kinematic connections, between the chronograph drive wheel and the chronograph wheel set, resulting in opposite directions and/or different rotational speeds of the chronograph wheel set.

Thus, the subject of the present invention, by means of the different functional and structural aspects described above, provides a relatively compact yet relatively simple to implement selection member.

According to the invention, the selection member includes:

- an actuator,
- at least one lever configured to take at least first and second positions, respectively corresponding to the first and second functions, and respectively corresponding to the creation of first and second kinematic connections,
- a cam cooperating with the actuator and the at least one lever in order to create the first and second kinematic connections.

In accordance with other advantageous variants of the invention:

- the at least one lever, called the first lever, includes a lower plate and an upper plate between which are arranged a first gear train and a second gear train, capable of being moved between the first and second positions, wherein the first gear train engages with the chronograph drive wheel and is kinematically connected to the chronograph wheel set in the first position, and the second gear train engages with the chronograph drive wheel and is kinematically connected to the chronograph wheel set in the second position;
- the first gear train and/or the second gear train is a reduction gear and/or reverser;
- the selection member is capable of being moved into a third position, associated with a third function, and corresponding to the creation of a third kinematic connection between the chronograph drive wheel and the chronograph wheel set;
- the movement includes a second lever corresponding to the third function, and corresponding to the creation of the third kinematic connection;
- the second lever is mounted to pivot on the first lever and includes a gear train configured to cooperate with the first and second gear trains in the third position;
- the movement includes a rocking member mounted to pivot on the first lever and cooperating with the second lever, the rocking member being configured to arrange the selection member in the third position;
- the cam includes an upper shuttle-like element, a lower shuttle-like element and a ratchet, disposed around a pivot axis, and respectively arranged to cooperate with the rocking member, the lower plate of the first lever, and the actuator;
- the selection member includes a first strip-spring forcing the first lever into the first position;
- the rocking member includes a return spring arranged to hold the rocking member when the first lever is in the first position or the second position;

The invention also concerns a timepiece fitted with a movement according to the invention.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 1A:
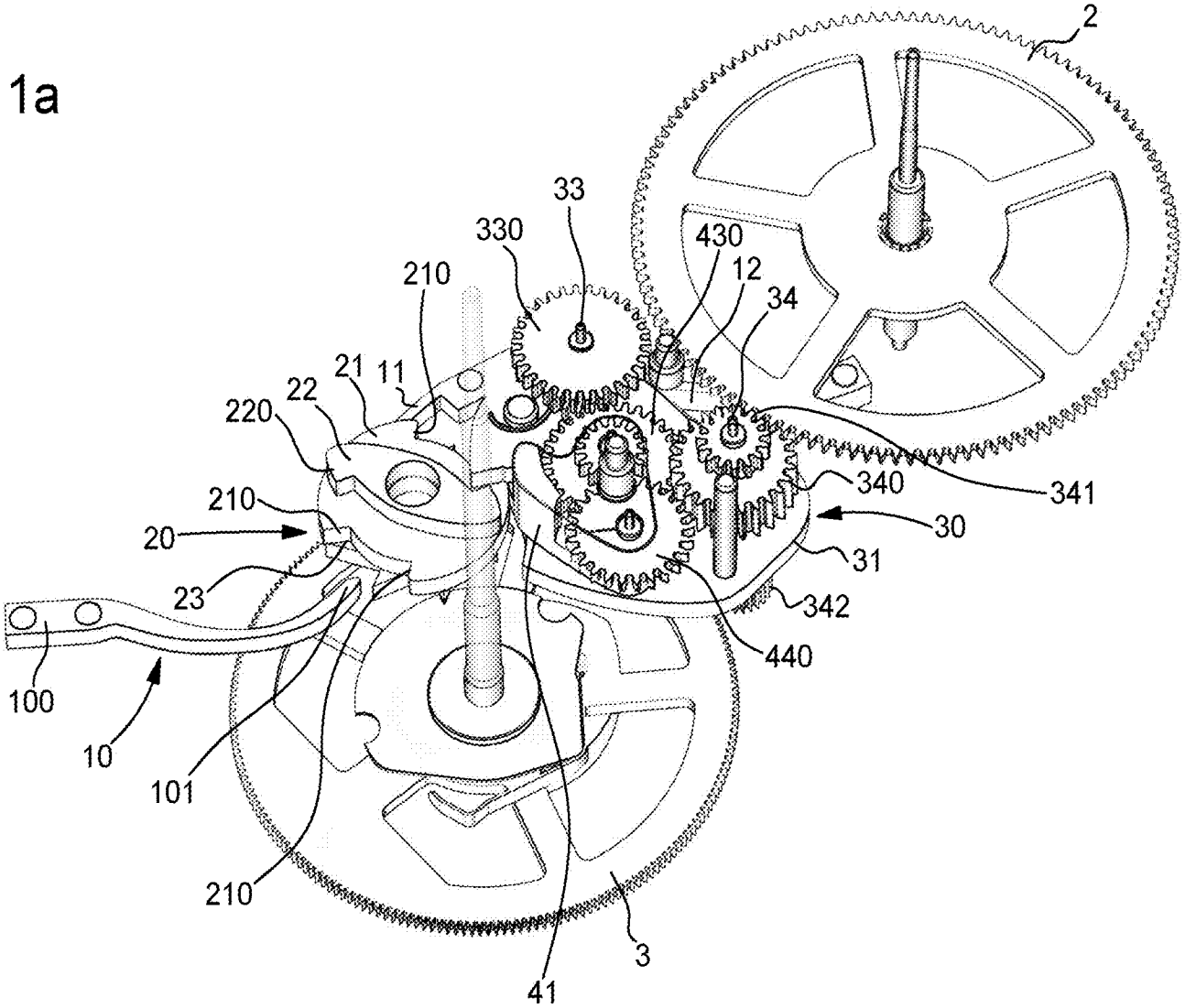
FIGS. 1*a* and 1*b* respectively illustrate a perspective view and an exploded perspective view of a timepiece movement according to the invention.

A timepiece movement according to an example embodiment will now be described below with reference jointly to FIGS. 1*a* to 4*b*.

Timepiece movement 1 is arranged to allow the display of the hours and minutes by means of an hour wheel, a minute wheel, and a seconds wheel, in a conventional manner.

As stated above, the main principle of the invention relies on the implementation of a timepiece movement having at least first and second functions implementing the display of at least first and second pieces of information, the timepiece movement notably including:

- a chronograph drive wheel 2,
- a chronograph wheel set 3,
- a selection member capable of being moved between at least first and second positions, respectively associated with the first and second functions, and respectively corresponding to the creation of first and second respective kinematic connections, between the chronograph drive wheel 2 and the chronograph wheel set 3, resulting in opposite directions and/or different rotational speeds of the chronograph wheel set 3.

According to the invention, the selection member includes:

- an actuator 10,
- at least one lever configured to take at least first and second positions, respectively corresponding to the first and second functions, and respectively corresponding to the creation of first and second kinematic connections,
- a cam 20 cooperating with actuator 10 and the at least one lever in order to create the first and second kinematic connections.

In this example, the frame members of timepiece movement 1 and the current time components are not shown, while some components are transparent for ease of understanding.

According to a preferred embodiment of the invention, movement 1 includes at least a chronograph and countdown mechanism, each mechanism being selectable using the same selection member. Chronograph drive wheel 2 and chronograph wheel set 3 are shown in the Figures to best illustrate the various kinematic connections of the functions.

Figure 1B:
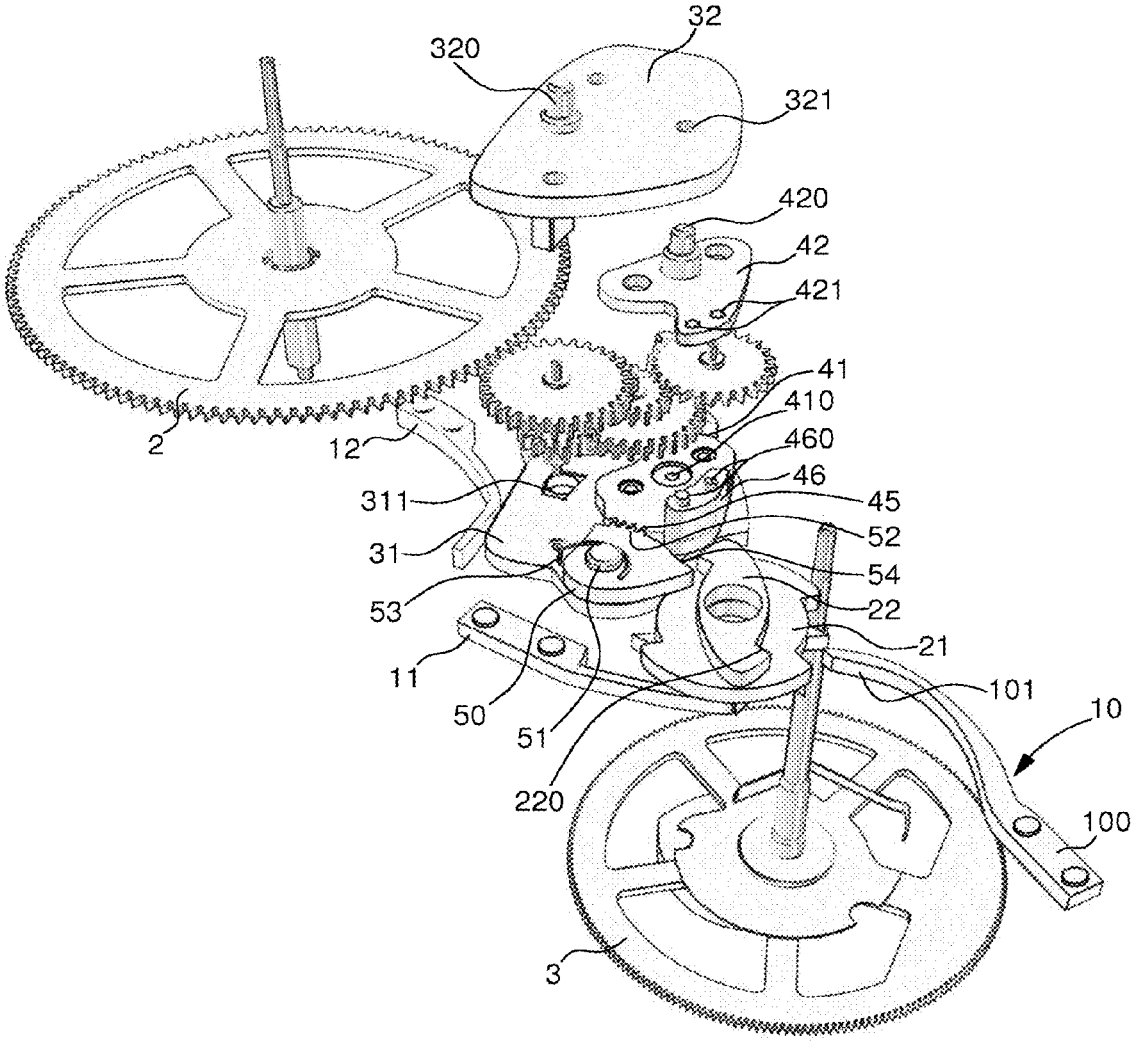

FIG. 1*b* illustrates an exploded perspective view of one part of a timepiece movement 1 equipped with a selection member further including an actuator 10, one end of which includes an actuating finger 101 for selecting a function. The other end 100 of actuator 10 may, for example, cooperate with a push-button actuated by the user.

Actuator 10 is slidably mounted on a frame member of the movement to allow finger 101 to move in a longitudinal direction, and it is arranged to cooperate with elastic return means (not shown in the Figures), to remain in position at rest.

Actuating finger 101 is arranged to cooperate with a cam 20 mounted to pivot on a frame member of timepiece movement 1 between at least two positions, around an axis of rotation located at the centre of cam 20, one of the positions being associated with the chronograph function and the other with the countdown function.

As can be observed in FIGS. 1*a* and 1*b*, cam 20 includes at least a first shuttle-like element, called "lower shuttle-like element" 21, a second shuttle-like element, called "upper shuttle-like element" 22, and a ratchet arranged around the same pivot axis. As illustrated in the Figures, lower and upper shuttle-like elements 21 and 22 respectively have a beak 210 and a beak 220 at each end thereof, the beaks being arranged symmetrically with respect to the centre of rotation of cam 20.

The selection member also includes a lever, called first lever 30. First lever 30 is formed by a lower plate 31 and upper plate 32 between which are arranged a first gear train formed by a first arbor 33 receiving a toothed wheel 330 and a pinion 331 and a second gear train formed by a second arbor 34 receiving toothed wheel 340, an upper pinion 341 and a lower pinion 342.

Upper plate 32 and lower plate 31 are assembled to each other to form first lever 30, upper plate 32 having an upper pivot 320 arranged to be accommodated in the orifice of a bridge (not shown in the Figures) and lower plate 31 having an orifice 311 arranged to receive a pivot of another bridge. Advantageously, upper pivot 320 and orifice 311 are aligned on the same axis to form the axis of rotation of first lever 30.

The first gear train and second gear train are arranged to cooperate with the chronograph drive wheel 2 when the selection member is moved between the first and second positions corresponding to the first and second kinematic connections.

Figure 2A:
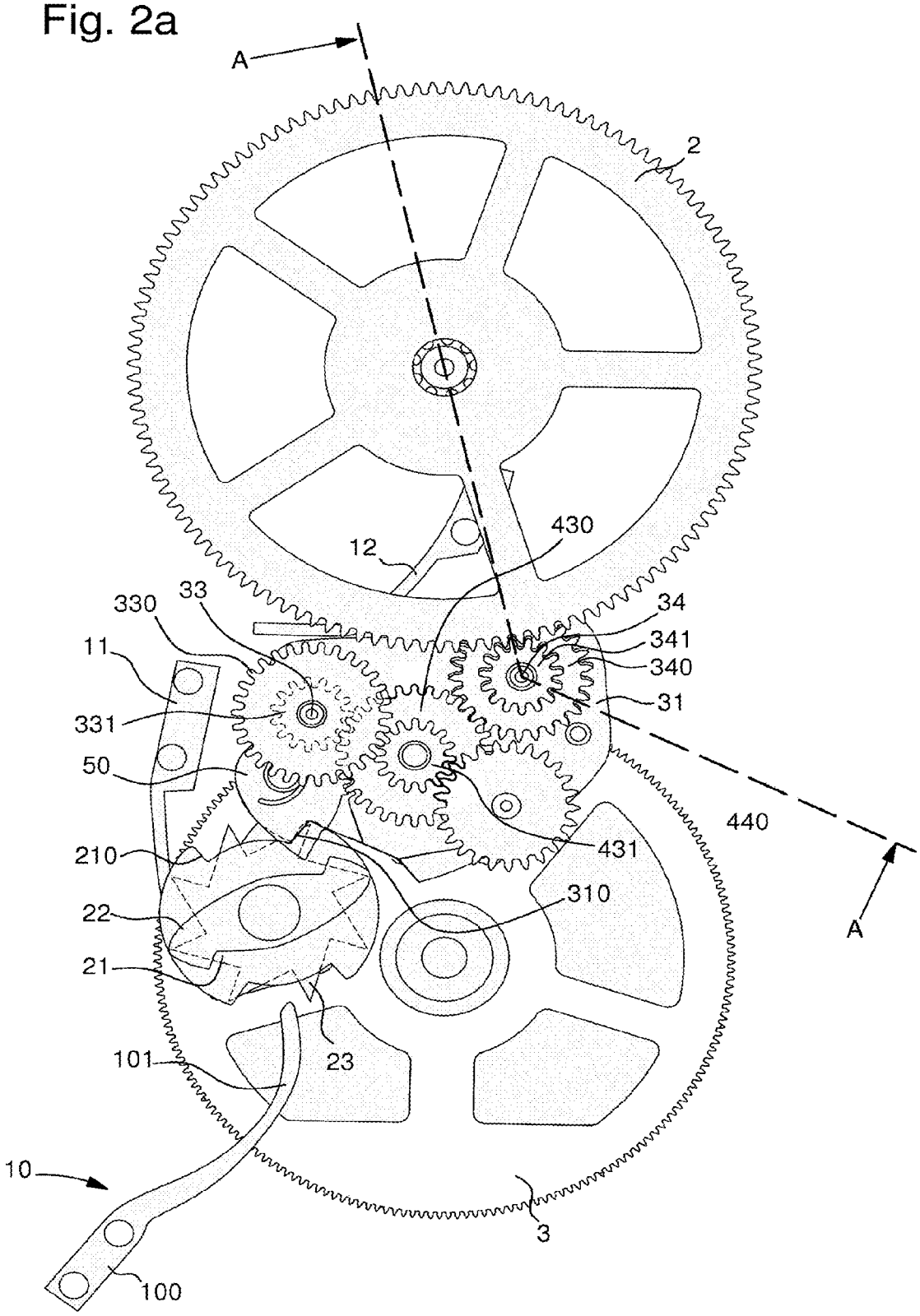
FIGS. 2*a* and 2*b* respectively show a top view and a sectional view along the line AA of a selection member of a timepiece movement according to the invention.
Figure 2B:
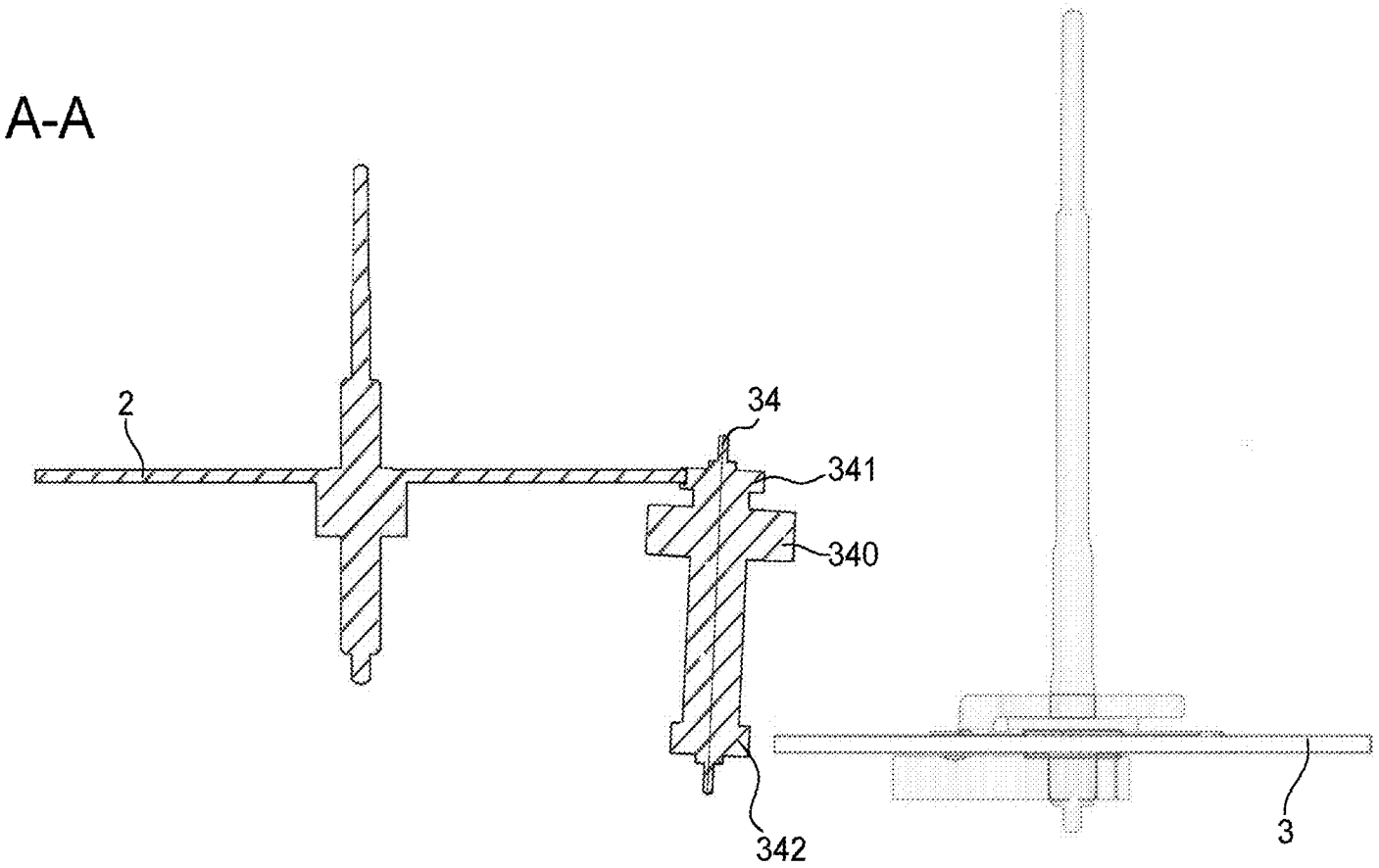

Thus, when the selection member is in a first position as illustrated in FIGS. 2*a* and 2*b*, upper pinion 341 engages with drive wheel 2 and is kinematically connected to chronograph wheel set 3 by means of lower pinion 342 located on the same arbor 34.

Figure 3A:
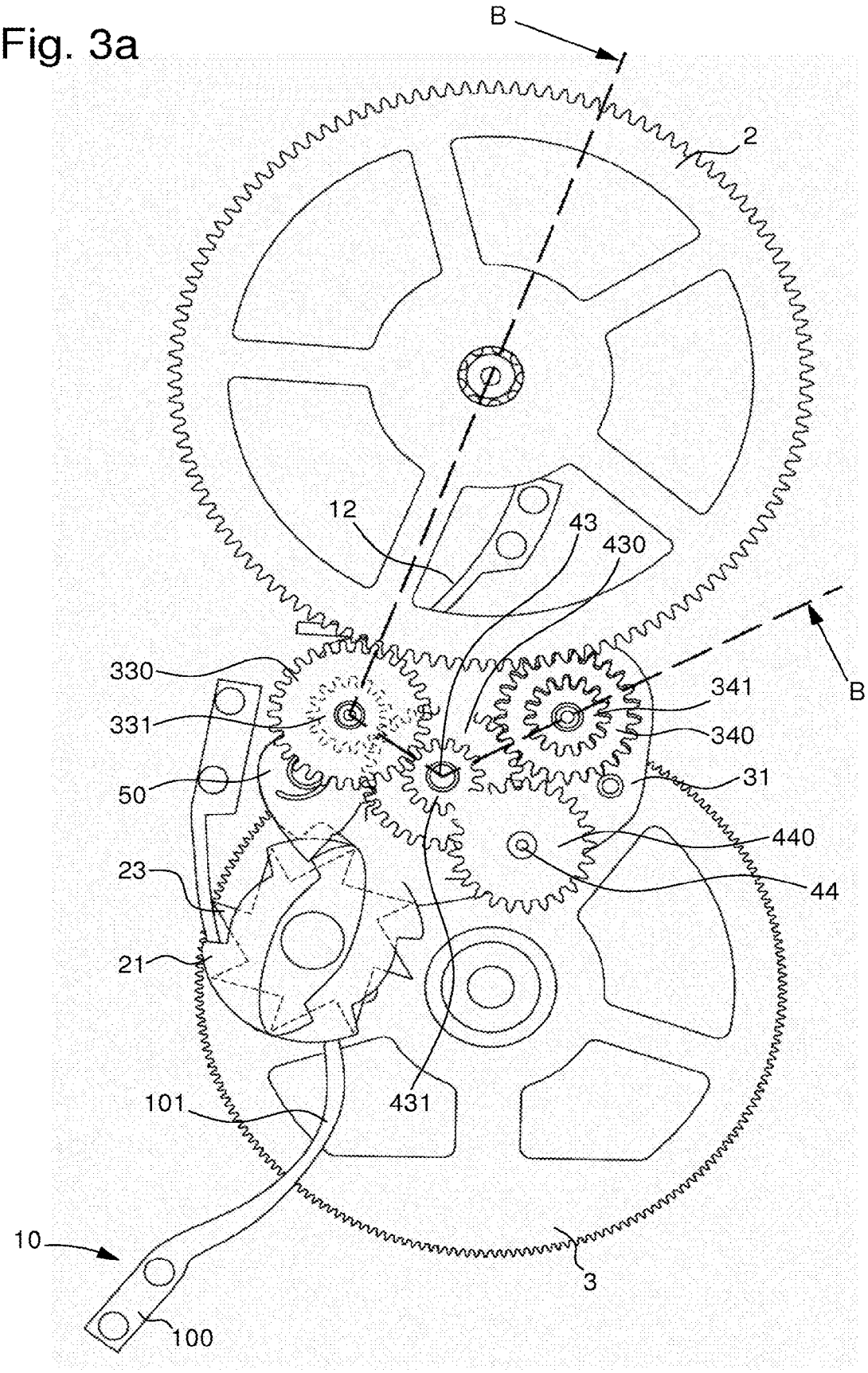
FIGS. 3*a* and 3*b* respectively show a top view and a sectional view along the line B-B of a selection member of a timepiece movement according to the invention.
Figure 3B:
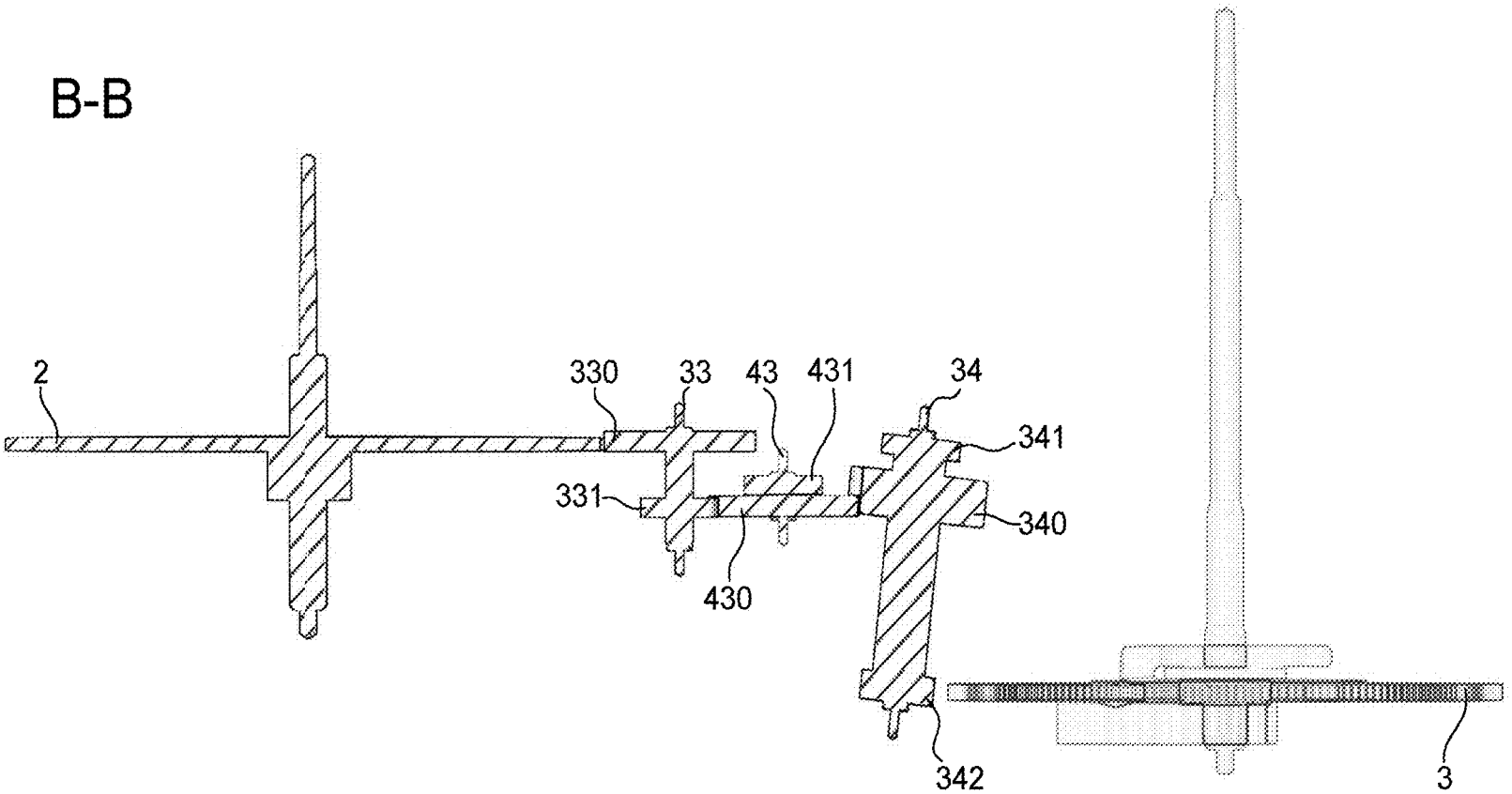

When the selection member is in the second position as illustrated in FIGS. 3*a* and 3*b*, wheel 330 of the second gear train engages with drive wheel 2 and is kinematically connected to chronograph wheel set 3 by means of pinion 331 which meshes with an intermediate wheel 430 meshing with wheel 340 of the second gear train connected to lower pinion 342 which drives chronograph wheel set 3.

According to the invention, the first gear train and/or the second gear train may be reduction gears and/or reversers depending on the functions required to be implemented in the watch. These functions may be, for example, a chronograph function, a countdown function, or even a chronograph function having a lower speed.

As can be observed in FIGS. 1 and 2*a*, lower plate 31 of first lever 30 has an engagement surface configured to cooperate with cam 20. More specifically, the beaks 210 of lower shuttle-like element 21 are configured to cooperate with engagement sector 310 of lower plate 31 so as to move first lever 30 in rotation.

Thus, to switch from the first operating mode to the second operating mode, the user presses a push-button (not shown in the Figures) connected to actuator 10 so that actuating finger 101 actuates the rotation of ratchet 23 and also of lower shuttle-like element 21 which then abuts against engagement sector 310. This has the effect of pivoting first lever 30, of disengaging upper pinion 341 from chronograph drive wheel 2 and simultaneously engaging wheel 330 with chronograph drive wheel 2.

A strip-spring 11 is provided for retaining ratchet 23 and advancing it in steps when it is actuated in rotation by actuator 10.

Likewise, the selection member includes a second strip-spring 12 configured to define a default position of first lever 30 by exerting thereon a force to place it in the position associated with the first function, for example the chronograph function.

According to the invention, the selection member may be placed in a third position which is associated with a third function, and corresponds to the creation of a third kinematic connection between chronograph drive wheel 2 and chronograph wheel set 3.

Figure 4A:
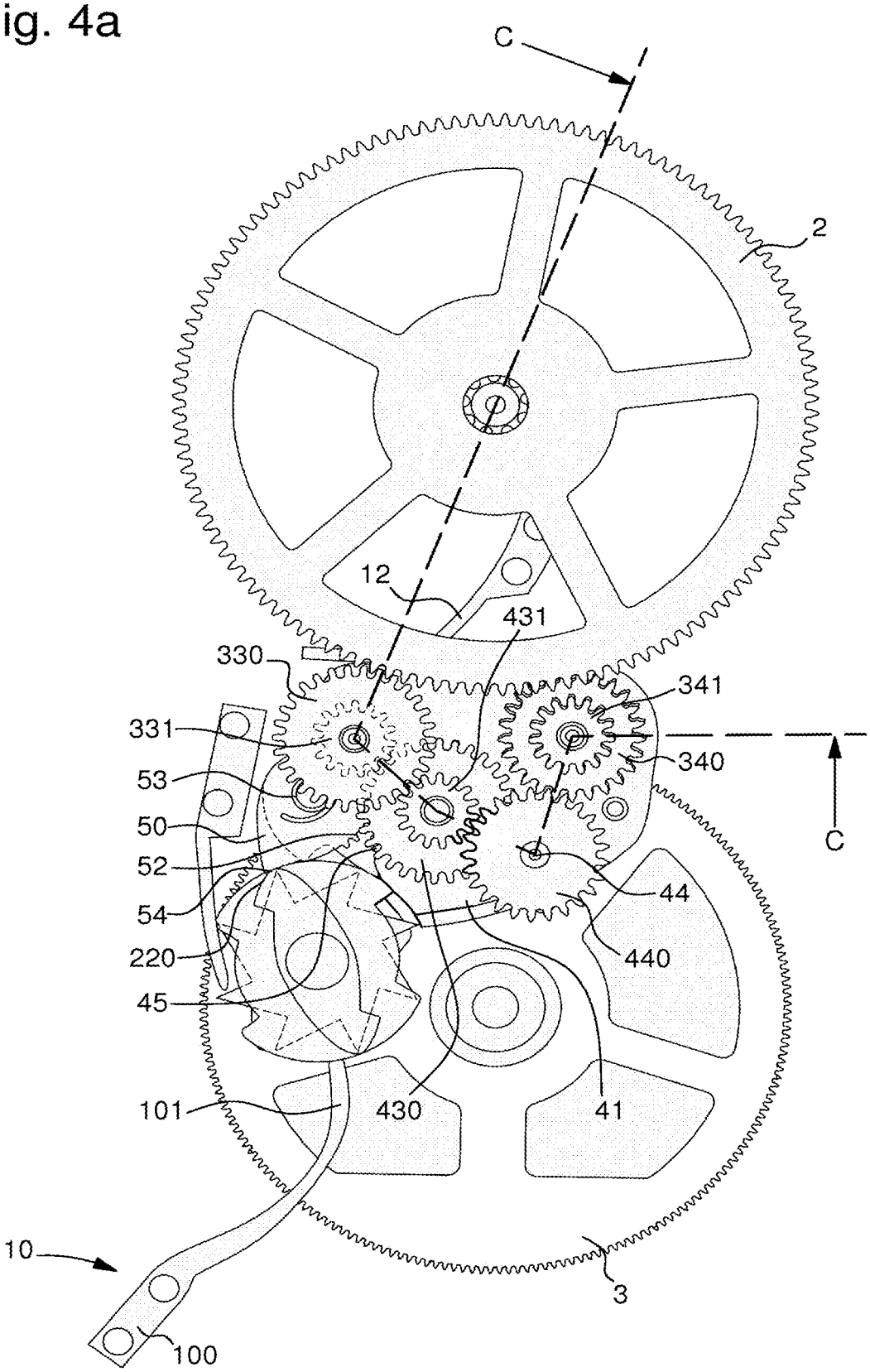
FIGS. 4*a* and 4*b* respectively show a top view and a sectional view along the line C-C of a selection member of a timepiece movement according to the invention.
Figure 4B:
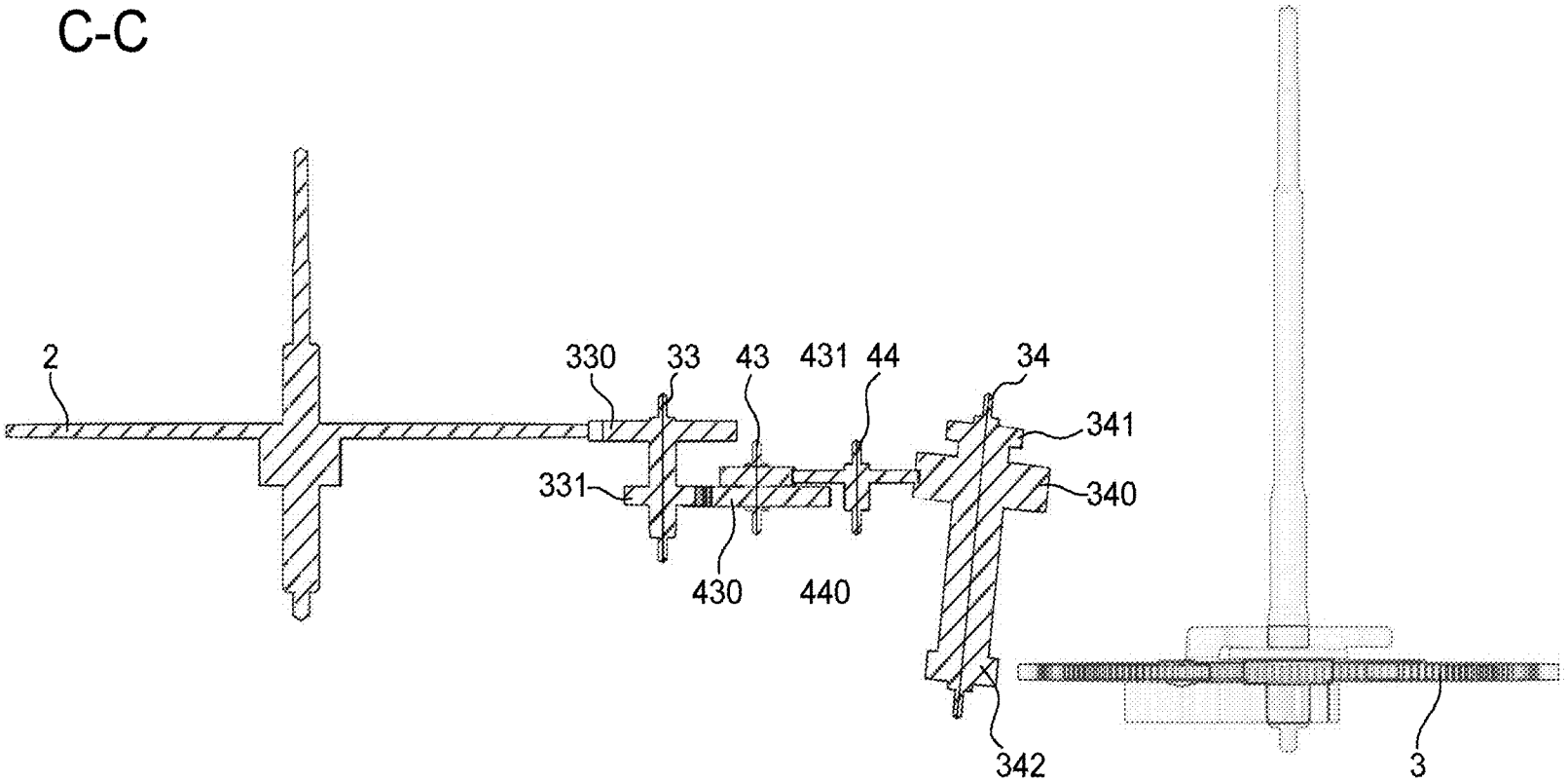

The selection member includes a second lever 40 for selecting the third function, and for creating the third kinematic connection seen in FIG. 4*b*.

According to a particularly advantageous aspect of the invention, second lever 40 is mounted to pivot on first lever 30.

As can be observed in FIG. 1*b*, second lever 40 includes a lower plate 41 mounted to pivot on lower plate 31 of first lever 30, and an upper plate 42 mounted to pivot on upper plate 32 of first lever 30.

Lower plate 41 has an orifice 410 configured to receive a pivot of lower plate 31 of first lever 30, and upper plate 42 has an upper pivot 420 configured to be accommodated in a hole 321 of upper plate 32 of first lever 30. Thus, upper pivot 420 and orifice 410 define the axis of rotation of second lever 40 with respect to first lever 30.

Upper plate 42 is assembled on lower plate 41 by means of an assembly element 46 integral with lower plate 41. This assembly element 46 includes two pins 460 configured to be accommodated in two corresponding openings 421 in upper plate 42.

Second lever 42 receives intermediate wheel 430 and intermediate pinion 431, and another wheel 440, respectively mounted between upper plate 42 and lower plate 41 by means of an arbor 43 and another arbor 44.

As can be observed in FIG. 1*b*, lower plate 41 of second lever 40 has a toothed sector 45 configured to cooperate with a rocking member 50 rotatably hinged by means of an arbor 51 on lower plate 31 of first lever 30.

Rocking member 50 also has a toothed sector 52 configured to cooperate with toothed sector 45 of second lever 40. Rocking member 50 also includes a return spring 53 exerting a return force returning it to its initial position when the selection member is placed in the first or second position.

As can be observed in FIGS. 1*a* and 1*b*, rocking member 50 has an engagement surface 54 configured to cooperate with the cam, beaks 220 of upper shuttle-like element 22 being configured to cooperate with engagement surface 54 of rocking member 50.

Thus, to switch into the third operating mode illustrated in FIGS. 4*a* and 4*b*, the user presses a push-button (not shown in the Figures) connected to actuator 10 such that actuating finger 101 actuates the rotation of ratchet 23 and of upper shuttle-like element 22, until upper shuttle-like element 22 abuts against engagement surface 310 and exerts a force on rocking member 50.

Rocking member 50 then drives in rotation second lever 40 by means of toothed sectors 45 and 52 so that intermediate pinion 431 meshes on the one hand with wheel 330, and on the other hand with wheel 440 which meshes with wheel 340 connected to chronograph wheel 3.

The invention also concerns a timepiece, such as a watch, fitted with one such movement.

According to one embodiment of the invention, the watch may include means for displaying the selected function. These display means may consist of an indicator hand on the watch dial or an aperture on the dial displaying the selected function.

As a result of these different aspects of the invention, there is provided a movement of simple design which allows easy selection and implementation of the desired function.

Of course, this invention is not limited to the illustrated example but is capable of various variants and alterations that will appear to those skilled in the art.

LIST OF PARTS

| | |
|---|---|
| 1. | Movement |
| 2. | Drive wheel |
| 3. | Chronograph wheel set |
| 10. | Actuator |
| 100. | End of the actuator |
| 101. | Actuating finger |
| 11. | Cam strip-spring |
| 12. | Lever strip-spring |
| 20. | Cam |
| 21. | Upper shuttle-like element |
| 210. | Beaks of the upper shuttle-like element |
| 22. | Lower shuttle-like element |
| 220. | Beaks of the lower shuttle-like element |
| 23. | Ratchet |
| 30. | First lever |
| 31. | Lower plate |
| 310. | Engagement sector |
| 311. | Lower pivot |
| 32. | Upper plate |
| 320. | Upper pivot |
| 321. | Hole |
| 33. | First arbor |
| 330. | Wheel |
| 331. | Pinion |
| 34. | Second arbor |
| 340. | Wheel |
| 341. | Upper pinion |
| 342. | Lower pinion |
| 40. | Second lever |
| 41. | Lower plate |
| 410. | Lower orifice |
| 42. | Upper plate |
| 420. | Upper pivot |
| 421. | Openings |
| 43. | First arbor |
| 430. | Intermediate wheel |
| 431. | Intermediate pinion |
| 44. | Second arbor |
| 440. | Wheel |
| 45. | Toothed sector |
| 46. | Assembly portion |
| 460. | Pins |
| 50. | Rocking member |
| 51. | Arbor of the rocking member |
| 52. | Toothed sector |
| 53. | Return spring |
| 54. | Engagement surface |

What is claimed is:

1. A timepiece movement comprising at least first and second functions implementing display of at least first and second pieces of information, the timepiece movement comprising:

a chronograph drive wheel, a chronograph wheel set, a selection member movable between at least first and second positions, respectively associated with the first and second functions, and respectively corresponding to creation of first and second respective kinematic connections, between the chronograph drive wheel and the chronograph wheel set, resulting in opposite directions and/or different rotational speeds of the chronograph wheel set, wherein the selection member comprises:

an actuator to be actuated by a user, a first lever configured to take at least first and second positions, respectively corresponding to the first and second functions, and respectively corresponding to the creation of first and second kinematic connections, and a cam cooperating with the actuator and the first lever in order to create the first and second kinematic connections, wherein the first lever comprises a lower plate and an upper plate between which are arranged a first gear train and a second gear train movable between the first and second positions, and wherein the first gear train engages with the chronograph drive wheel and is kinematically connected to the chronograph wheel set in the first position, and the second gear train engages with the chronograph drive wheel and is kinematically connected to the chronograph wheel set in the second position.

2. The timepiece movement according to claim 1, wherein the first gear train and/or the second gear train is a reduction gear and/or reverser.

3. The timepiece movement according to claim 1, wherein the selection member is movable into a third position, associated with a third function, and corresponding to creation of a third kinematic connection between the chronograph drive wheel and the chronograph wheel set.

4. The timepiece movement according to claim 3, comprising a second lever corresponding to the third function, and corresponding to the creation of the third kinematic connection.

5. The timepiece movement according to claim 4, wherein the second lever is mounted to pivot on the first lever and comprises a gear train configured to cooperate with the first and second gear trains in the third position.

6. The timepiece movement according to claim 5, comprising a rocking member mounted to pivot on the first lever and cooperating with the second lever, the rocking member being configured to arrange the selection member in the third position.

7. The timepiece movement according to claim 6, wherein the rocking member comprises a return spring arranged to hold the rocking member when the first lever is in the first position or the second position.

8. The timepiece movement according to claim 6, wherein the cam comprises an upper shuttle-like element, a lower shuttle-like element and a ratchet, disposed around a pivot axis and respectively configured to cooperate with the rocking member, a lower plate of the first lever, and the actuator.

9. The timepiece movement according to claim 1, wherein the selection member comprises a first strip-spring forcing the first lever into the first position.

10. A timepiece comprising the timepiece movement as claimed according to claim 1.

11. A timepiece movement comprising at least first and second functions implementing display of at least first and second pieces of information, the timepiece movement comprising:

a chronograph drive wheel, a chronograph wheel set, a selection member movable between at least first and second positions, respectively associated with the first and second functions, and respectively corresponding to creation of first and second respective kinematic connections, between the chronograph drive wheel and the chronograph wheel set, resulting in opposite directions and/or different rotational speeds of the chronograph wheel set, wherein the selection member comprises:

an actuator, at least a first lever configured to take at least first and second positions, respectively corresponding to the first and second functions, and respectively corresponding to the creation of first and second kinematic connections, and a cam cooperating with the actuator and the at least one lever in order to create the first and second kinematic connections, and wherein the first lever comprises a lower plate and an upper plate between which are arranged a first gear train and a second gear train movable between the first and second positions.

12. The timepiece movement according to claim 11, wherein the selection member is movable into a third position, associated with a third function, and corresponding to creation of a third kinematic connection between the chronograph drive wheel and the chronograph wheel set.

13. The timepiece movement according to claim 12, comprising a second lever corresponding to the third function, and corresponding to the creation of the third kinematic connection.

14. The timepiece movement according to claim 13, wherein the second lever is mounted to pivot on the first lever and comprises a gear train configured to cooperate with the first and second gear trains in the third position.

15. The timepiece movement according to claim 14, comprising a rocking member mounted to pivot on the first lever and cooperating with the second lever, the rocking member being configured to arrange the selection member in the third position.

16. The timepiece movement according to claim 15, wherein the rocking member comprises a return spring arranged to hold the rocking member when the first lever is in the first position or the second position.

17. The timepiece movement according to claim 15, wherein the cam comprises an upper shuttle-like element, a lower shuttle-like element and a ratchet, disposed around a pivot axis and respectively configured to cooperate with the rocking member, a lower plate of the first lever, and the actuator.

18. The timepiece movement according to claim 11, wherein the selection member comprises a first strip-spring forcing the first lever into the first position.

* * * * *